US006668919B2

(12) United States Patent
Radi

(10) Patent No.: US 6,668,919 B2
(45) Date of Patent: Dec. 30, 2003

(54) CASING HANGER SYSTEM WITH CAPTURE FEATURE

(75) Inventor: Amin Radi, Nassau Bay, TX (US)

(73) Assignee: ABB Vetco Gray Inc., Houston, TX (US)

( * ) Notice: Subject to any disclaimer, the term of this patent is extended or adjusted under 35 U.S.C. 154(b) by 0 days.

(21) Appl. No.: 10/077,395

(22) Filed: Feb. 15, 2002

(65) Prior Publication Data

US 2002/0121368 A1 Sep. 5, 2002

Related U.S. Application Data

(60) Provisional application No. 60/272,418, filed on Mar. 1, 2001.

(51) Int. Cl.[7] ..... E21B 43/10
(52) U.S. Cl. ..... 166/208; 166/382
(58) Field of Search ..... 166/382, 208

(56) References Cited

U.S. PATENT DOCUMENTS 4,595,063 A * 6/1986 Jennings et al. ..... 166/382
4,691,780 A * 9/1987 Galle et al. ..... 166/348
4,842,307 A * 6/1989 Sweeney et al. ..... 285/123.3
4,928,769 A 5/1990 Milberger et al.
4,969,516 A 11/1990 Henderson et al.
5,044,442 A 9/1991 Nobileau
5,372,201 A 12/1994 Milberger
5,813,470 A * 9/1998 Radi ..... 166/382

* cited by examiner

*Primary Examiner*—David Bagnell
*Assistant Examiner*—G M Collins
(74) *Attorney, Agent, or Firm*—Bracewell & Patterson, L.L.P.

(57) ABSTRACT

A stacking arrangement for wellhead tubular members wherein the adjoining ends of the tubular members are specially shaped to prevent or limit outward radial deflection and the damage associated therewith. A casing hanger is provided with an upper longitudinal end having an inwardly sloped inner bearing surface and an inwardly sloped outer bearing surface. An outwardly sloped engagement surface adjoins the two bearing surfaces and is designed to be captured radially within a complimentary shaped surface on a running tool or other engaging member landed atop the casing hanger. A grooved section is provided to assist removal of trash from the upper end of the casing hanger.

15 Claims, 4 Drawing Sheets

CASING HANGER SYSTEM WITH CAPTURE FEATURE

CROSS-REFERENCE TO RELATED APPLICATIONS

This application claims the benefit of U.S. Provisional Application Ser. No. 60/272,418 filed Mar. 1, 2001.

BACKGROUND OF THE INVENTION

1. Field of the Invention

The present invention relates to casing hanger systems and other systems in which a tubular member is landed atop another. The invention also relates more broadly to devices and methods to relieve the problems generally related to stacked tubular members that are placed under high axial load conditions.

2. Description of the Related Art

In many conventional subsea wellheads, the upper end of the casing hanger engages a running tool by a seating arrangement wherein the casing hanger presents an annular upwardly and inwardly directed seating surface. One standard casing hanger top surface is a flat surface, angled at 15 degrees from the horizontal, facing upward and radially inward. The slope is intended to allow "trash," such as bits of rock and mud impurities, to fall off the top surface. The slope also aids in radially guiding and landing the running tool atop the casing hanger or in placing a second casing hanger atop a lower casing hanger. The running tool that engages the upper end of the casing hanger provides a complimentary downwardly and outwardly-directed annular engagement face. Sometimes, locking dogs are also used to aid in securing the two members together.

Unfortunately, this form of engagement has been found to be disadvantageous. The running tool exerts great weight loads onto the seating surface. Also, multiple casing hangers are often stacked upon one another. This is done when multiple casings are run. The additional casing hangers would also load the seating surface. The loads imparted to the casing hanger are directly related to the weight of the casing string sections being carried by the casing hanger and running tool. The loads are extremely high and may be in excess of a million pounds. The axial force applied to the upper end of the casing hanger by the running tool is damaging to the casing hanger and, as a result the upper end of the casing hanger may deflect radially outwardly reducing the engagement of the running tool and casing hanger. Radial deflection at the upper end of the casing hanger reduces the fatigue life of the casing hanger equipment.

SUMMARY OF THE INVENTION

A stacking arrangement for wellhead tubular members is described wherein the adjoining ends of the tubular members are specially shaped to prevent or limit outward radial deflection and the damage associated therewith. In an exemplary described embodiment, a casing hanger is provided with an upper longitudinal end having an inwardly sloped inner bearing surface and an inwardly sloped outer bearing surface. An outwardly sloped engagement surface adjoins the two bearing surfaces and is designed to be captured radially within a complimentary shaped surface on a running tool or other engaging member landed atop the casing hanger. A grooved section is provided to assist removal of trash from the upper end of the casing hanger.

DETAILED DESCRIPTION OF PREFERRED EMBODIMENTS

The present invention provides an improvement that is generally applicable to instances in which one tubular member is stacked atop another, particularly in a bore. In an exemplary embodiment described herein, the subject matter of the present invention has particular applicability to subsea casing hanger systems.

Figure 1:
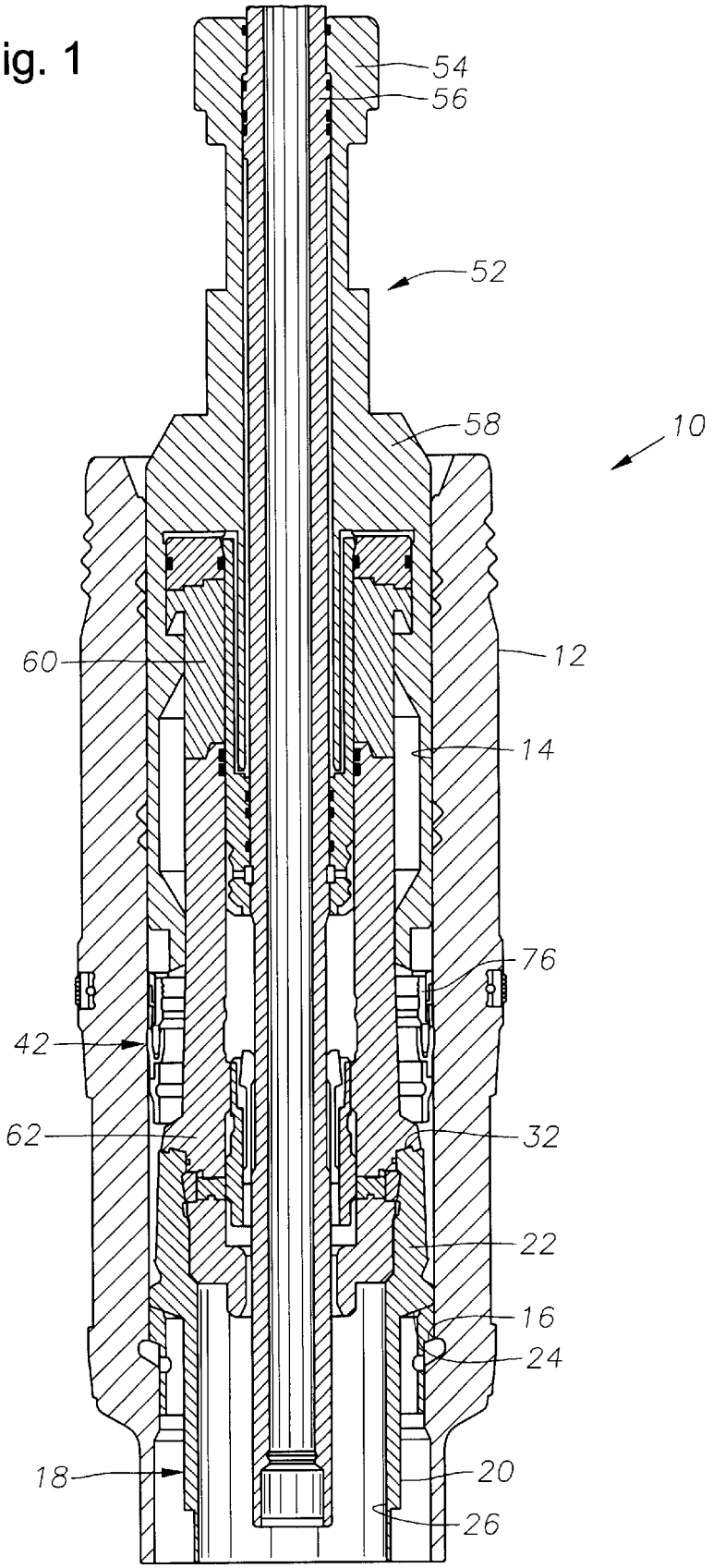
FIG. 1 is a cross-sectional cut-away view of a wellhead housing and casing hanger constructed in accordance with the present invention. A running tool is located atop the casing hanger.
Figure 2:
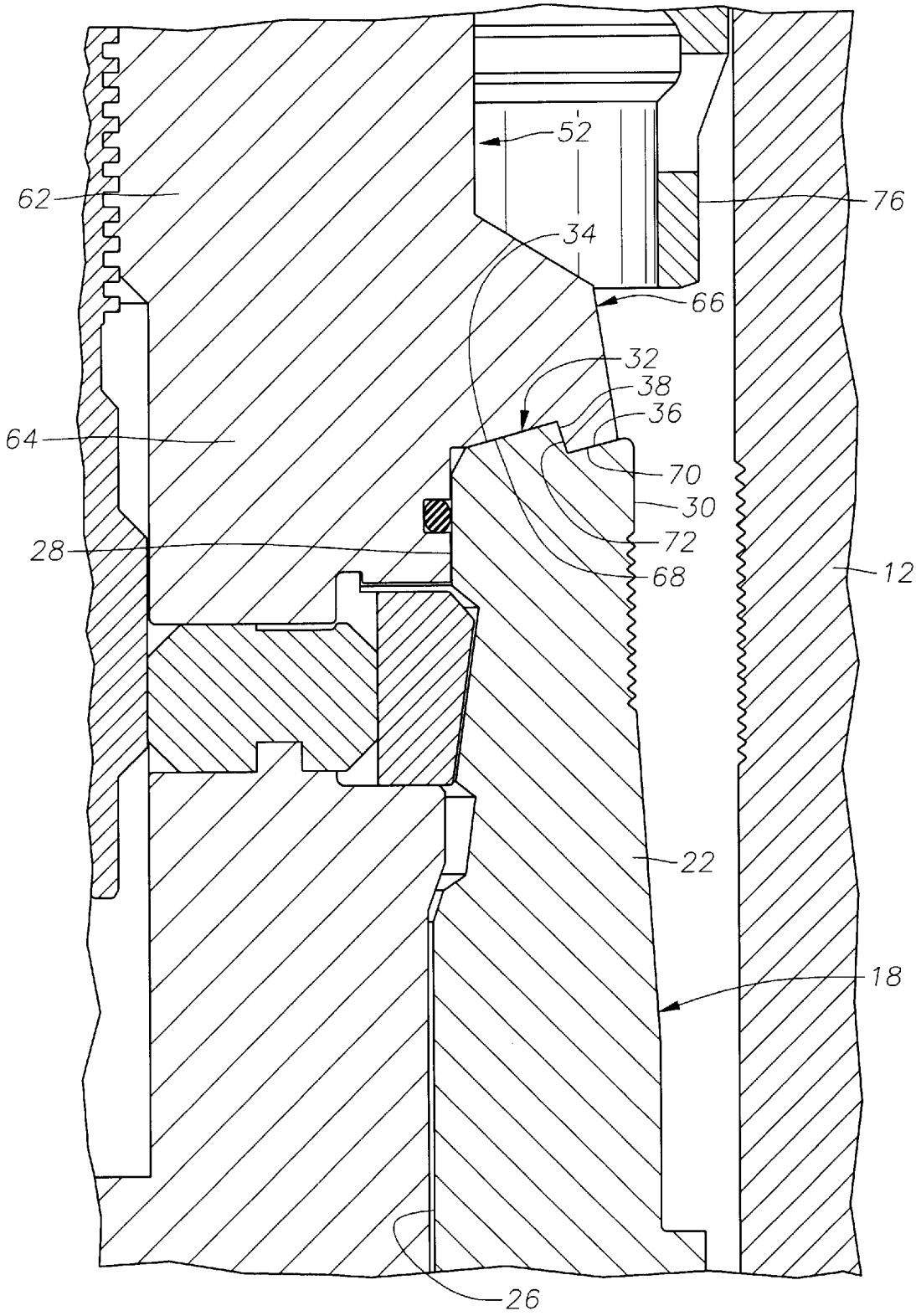
FIG. 2 is an enlarged view of the portions of the casing hanger that are illustrated in FIG. 1.

FIGS. 1 and 2 depict, in cross-section, portions of a subsea wellhead 10 that incorporates a casing hanger system. Because the general aspects of construction and operation of subsea wellheads and casing hanger systems are well understood by those of skill in the art, those aspects will not be described here in significant detail except for purposes of providing a background for illustrating the invention.

The wellhead, schematically shown at 10, has a radially outer wellhead housing 12 that encloses a central bore 14. An inwardly and upwardly directed casing hanger seat 16 is located proximate the lower end of the bore 14.

A casing hanger 18 is disposed within the bore 14 and seated upon the casing hanger seat 16. The casing hanger 18 has a reduced diameter lower portion 20 and a larger diameter upper portion 22. The intersection between the two portions forms a downwardly facing shoulder 24. A bore 26 is defined centrally within the casing hanger 18.

The upper end of the casing hanger 18 is best shown in FIG. 2 and features two substantially parallel inner and outer walls 28 and 30, respectively. A shaped, annular upper landing surface 32 interconnects the inner and outer walls 28, 30. The upper surface 32 includes an inwardly sloped inner bearing surface 34 and an inwardly sloped outer bearing surface 36. An outwardly sloped engagement surface 38 adjoins the inner and outer bearing surfaces 34, 36. The engagement surface 38 is designed to be captured radially within a complimentary shaped surface on a running tool or other engaging member above the casing hanger 18. Preferably, the engagement surface 38 is normal to the upper surface 32.

There is preferably a grooved section 40 (illustrated here in FIG. 4) within a radial portion of the upper surface 32 to help remove trash from the upper surface 32 of the casing hanger 18. The grooved section includes at least one radial groove 40 that is formed by cutting away a portion of the inner bearing surface 34 so that the outer bearing surface 36 becomes substantially continuous to the bore 26. Trash and impurities may then be flowed through the groove 40 into the bore 26 rather than becoming hung up against the engagement surface 38. There may be multiple grooved sections located at angular intervals about the circumference of the casing hanger 18.

Figure 4:
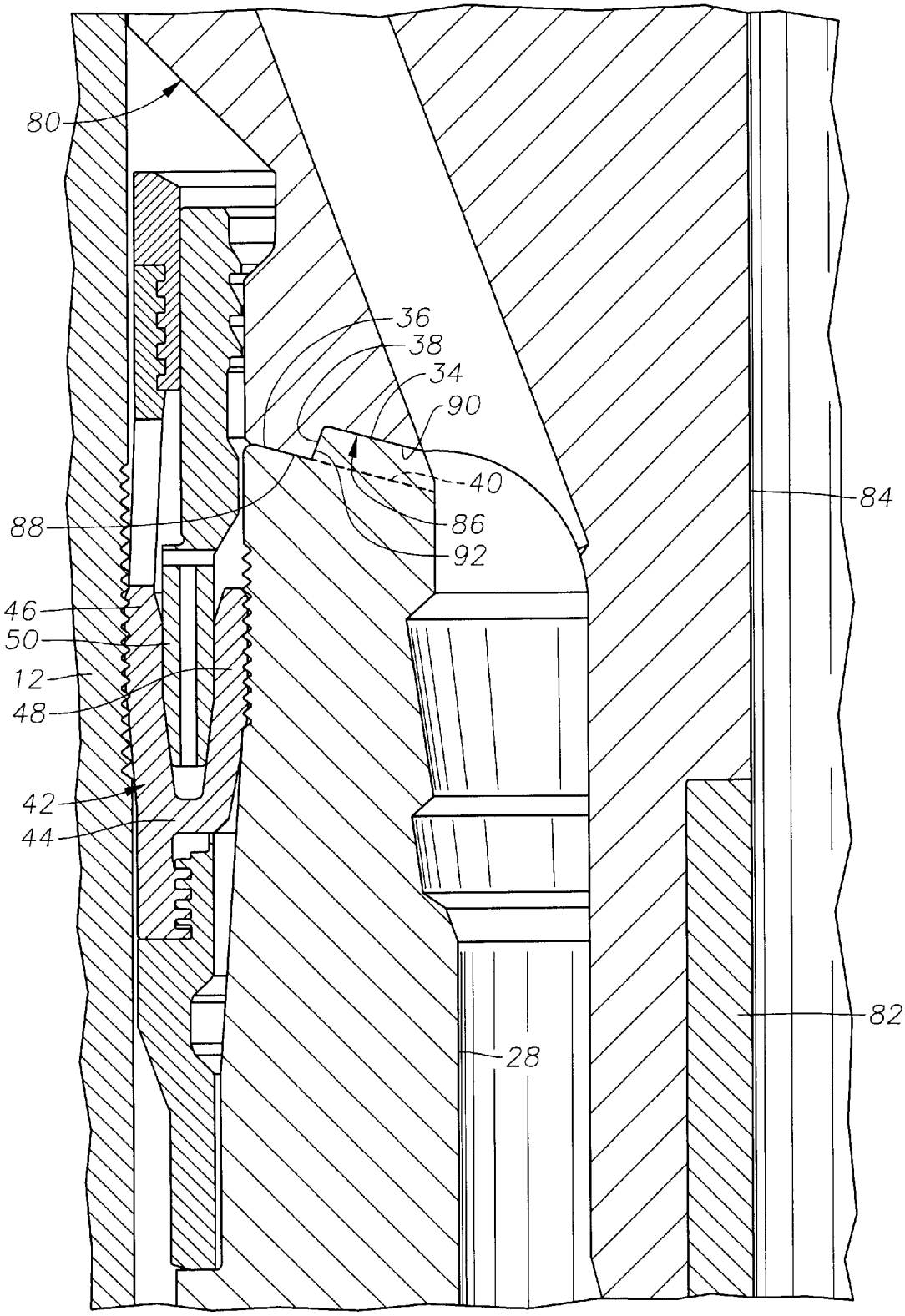
FIG. 4 is an enlarged view of portions of FIG. 3.

A casing hanger packoff 42, such as the MS-i seal, is shown located on inside of wellhead housing 12 in FIG. 1. The packoff 42 is adapted to provide a fluid tight seal between the bore 14 of the wellhead housing 12 and the upper portion 22 of the casing hanger 18. The packoff 42 is best shown in FIG. 4 and includes a U-shaped seal member 44 with a pair of legs 46, 48 that extend upwardly. The packoff 42 also includes a separate compression ring 50 that is selectively insertable between the legs 46, 48. The packoff 42 is moveable by a running tool between an unset position above the casing hanger 18 (shown in FIG. 1) and a set position that is shown in FIG. 4. In its conventional role, the packoff 42 has also helped to resist outward radial forces and outward deformation of the upper end of the casing hanger 18 when set.

A running tool 52 is shown in FIGS. 1 and 2 to be radially disposed within the casing hanger 18 and is useful for setting the casing hanger 18 within the wellhead housing 12 and setting the packoff 42. The running tool 52 may be a known running tool assembly suitable for these purposes, such as the DPRT (drill pipe running tool) available commercially from ABB Vetco, Inc. The DPRT running tool is ideal since it is capable of performing multiple operations including setting the packoff seal 42 and running casing sections. A standard DPRT, or other running tool, will of course have to be modified to operably interact with the capture feature portions of the upper end of the casing hanger 18. These modifications will be described shortly. The upper end 54 of the running tool 52 is affixed to drill pipe 56, which is used to lower the casing hanger 18 from a drilling vessel. The running tool 52 supports that casing hanger 18, packoff 42, and the string of casing when it is run into the well. The running tool 52 features an upper collar 58 that is secured to a central mandrel 60.

The mandrel 60 provides a lower extension portion 62 having a radially inner cylindrical portion 64 (see FIG. 2) and a radially protruding, surrounding annular gripping portion 66. The gripping portion 66 is shaped and sized to mate with and engage the upper surface 32 of the casing hanger 18. Thus, the gripping portion 66 provides a downwardly facing recessed annular bearing face 68 and a non-recessed annular bearing face 70 that lies radially outside of the recessed bearing face 68. An inwardly directed engagement face 72 interconnects the two bearing faces 68, 70. When the running tool 52 is engaged with the upper end 22 of the casing hanger 18, the recessed annular bearing face 68 of the running tool 52 adjoins the inner bearing face 34 of the casing hanger 18. The non-recessed face 70 of the running tool 52 adjoins the outer bearing face 36 of the casing hanger 18, and the engagement face 72 of the running tool 52 adjoins the engagement surface 38 of the casing hanger 18. The bearing faces 34, 36 of the upper surface 32 of the casing hanger 18 receive and absorb the major downward or axial loads upon the casing hanger 18 that are imposed by the running tool 52. Because the inwardly-directed engagement surface 38 of the gripping portion 66 matingly adjoins the inwardly-directed engagement face 72 of the running tool 52, radial outward deflection of the upper end of the casing hanger 18 is prevented. Thus, the upper end of the casing hanger 18 is considered to be radially captured by the running tool 52.

Referring again to FIGS. 1 and 2, a radially outer seal setting portion 76 is shown extending downwardly from the collar 58 of the running tool 52. The seal setting portion is shaped and sized to engage the compression ring 50 of the packoff seal 42 and urge it into the seal member 44 so that the seal 42 becomes energized. In addition, the seal 42 is moved downwardly by the seal setting portion 76 to a location wherein it is disposed between the casing hanger 18 and the wellhead housing 12.

During an operation in which the casing hanger 18 is landed, the running tool 52 is affixed to the casing hanger 18 at its lower end and to a string of drill pipe 56 at its upper end. The running tool 52 is lowered on the drill pipe string until the casing hanger 18 is seated within the wellhead housing 12. Casing (not shown) is then cemented into place, in a manner that is known in the art. The running tool 52 is then rotated and run in further to set the seal 42.

Figure 3:
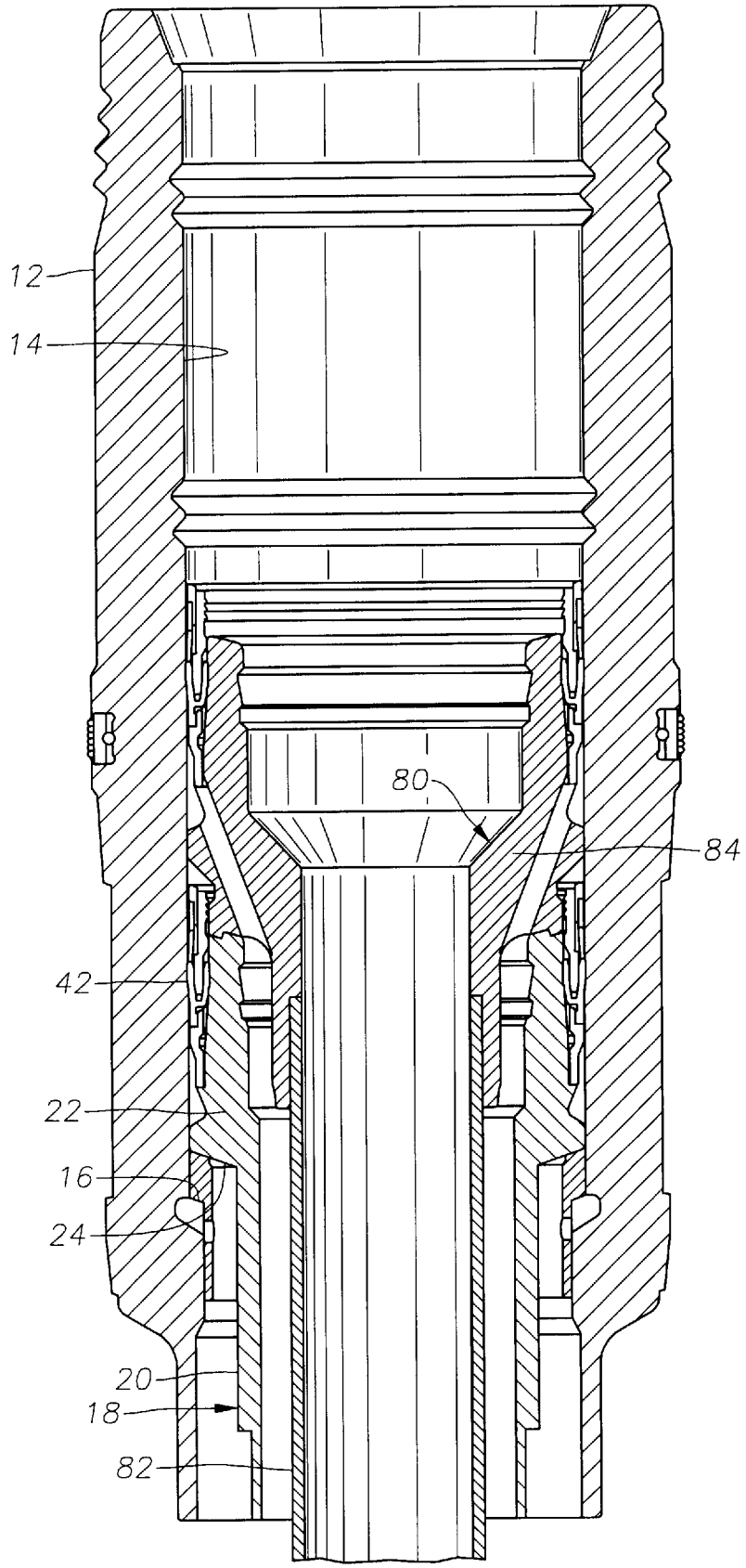
FIG. 3 is a cross-sectional cut-away view of a wellhead housing and primary casing hanger constructed in accordance with the present invention. A second casing hanger is installed atop the primary casing hanger.

Although a running tool 52 is illustrated in FIGS. 1 and 2 as contacting and engaging the upper end of the casing hanger 18, it is pointed out that other tools or devices would do so in a similar manner. These alternative tools or devices include a second casing hanger, a wear bushing, plug type test tool or BOP isolation test tool. FIGS. 3 and 4 depict a second, upper casing hanger 80 that has been stacked atop the primary, lower casing hanger 18 so that a second casing string may be coaxially disposed within the first casing string. The second casing hanger 80 has a radially reduced tubular lower section 82 and an enlarged diameter upper section 84 that is threadedly affixed thereto.

The lower end of the enlarged upper section 84 of the second casing hanger 80 is modified so that it can sit atop the lower, or primary casing hanger 18. The modification is that the upper section 84 is provided with a downwardly facing seating surface 86 that is shaped to be complimentary to the upper seating surface 32 of the lower casing hanger 18. The downwardly facing seating surface 86 includes inner and outer bearing faces 88, 90 and an engagement face 92 that are similar or identical to the faces 68, 70 and 72 described earlier with respect to the running tool 52.

If the primary casing hanger 18 is landed in a subsea high pressure housing, one could test above it or put another casing hanger above it (see FIGS. 3 and 4) and not worry about the radial deflection because the profile prevents the casing hanger from deflecting outward even if the seal is not there. The capture feature provided by the present invention is beneficial since it prevents, to a great degree, outward radial deflection of the upper portions of the casing hanger in response to axial loading. The design, therefore, increases the bearing capacity of a casing hanger. The presence of a pair of sloped surfaces also performs a guidance function.

While the invention has been shown in only some of its forms, it should be apparent to those skilled in the art that it is not so limited, but is susceptible to various changes without departing from the scope of the invention.

What is claimed is:

1. A casing hanger comprising:

a generally tubular body that encloses a central bore, the body having upper and lower longitudinal ends;

the upper end presenting a landing surface for receiving a running tool, the landing surface having:

an inner bearing surface that is inwardly sloped;

an outer bearing surface that radially surrounds that inner bearing surface; and an engagement surface that adjoins both the inner and outer bearing surfaces, and faces outwardly for contact with the running tool to limit outward deflection of the upper end of the casing hanger.

2. The casing hanger of claim 1 wherein the upper end further comprises a grooved section having at least one radially disposed groove that extends between the bore and the engagement surface.

3. The casing hanger assembly of claim 1, further comprising a casing hanger seal assembly located on an exterior portion of the casing hanger assembly, the outer bearing surface being located radially inward from the casing hanger seal assembly.

4. A casing hanger comprising:

a generally tubular body that encloses a central bore, the body having upper and lower longitudinal ends;

the upper end presenting a landing surface having:

an inner bearing surface that is inwardly sloped;

an outer bearing surface that radially surrounds that inner bearing surface; and an engagement surface that adjoins both the inner and outer bearing surfaces, the engagement surface having an outward slope; and wherein the outer bearing surface is inwardly sloped.

5. A casing hanger assembly within a wellbore comprising:

a casing hanger comprising a generally tubular body that encloses a central bore, the body having upper and lower longitudinal ends the upper end presenting a landing surface having an inner bearing surface that is inwardly sloped, an outer bearing surface that radially surrounds that inner bearing surface, and an engagement surface that adjoins both the inner and outer engagement surfaces, the engagement surface having an outward slope; and an upper engaging member for selective engagement of the casing hanger, the upper engaging member comprising a lower engagement surface having an annular gripping portion for engaging the engagement surface of the casing hanger.

6. The casing hanger assembly of claim 5 wherein the upper engaging member comprises a running tool.

7. The casing hanger assembly of claim 5 wherein the upper engaging member comprises a second casing hanger.

8. The casing hanger assembly of claim 5 further comprising a grooved section in the landing surface of the casing hanger, the grooved section having at least one radially disposed groove that adjoins the bore.

9. The casing hanger assembly of claim 5 further comprising an annular packoff seal that is selectively set by the upper engaging member.

10. The casing hanger assembly of claim 5 wherein the outer bearing surface is inwardly sloped.

11. A casing hanger assembly within a wellbore comprising:

a casing hanger comprising a generally tubular body, the body having upper and lower longitudinal ends the upper end presenting a landing surface having an inner bearing surface that is inwardly sloped, an outer bearing surface that radially surrounds that inner bearing surface, the outer bearing surface being inwardly sloped, and an engagement surface that adjoins both the inner and outer engagement surfaces, the engagement surface having an outward slope; and an upper engaging member for selective engagement of the casing hanger, the upper engaging member comprising a lower engagement surface having an annular gripping portion for engaging the engagement surface of the casing hanger.

12. The casing hanger assembly of claim 11 wherein the upper engaging member comprises a running tool.

13. The casing hanger assembly of claim 11 wherein the upper engaging member comprises a second casing hanger.

14. The casing hanger assembly of claim 11 further comprising a grooved section in the landing surface of the casing hanger, the grooved section having at least one radially disposed groove that adjoins the bore.

15. The casing hanger assembly of claim 11 wherein the body defines a central bore.

* * * * *

UNITED STATES PATENT AND TRADEMARK OFFICE

CERTIFICATE OF CORRECTION

PATENT NO. : 6,668,919 B2
DATED : December 30, 2003
INVENTOR(S) : Amin Radi

It is certified that error appears in the above-identified patent and that said Letters Patent is hereby corrected as shown below:

Column 2,
Line 61, delete “MS-i” and insert -- MS-1 --

Column 3,
Line 15, delete “ABB Vetco, Inc.” and insert -- ABB Vetco Gray Inc. --
Line 24, delete “that” before “casing”

Column 4,
Line 50, delete “that” after “surrounds” and insert -- the --

Column 5,
Line 3, delete “that” after “surrounds” and insert -- the --
Line 13, insert a (comma) -- , -- after “ends”
Line 16, delete “that” after “surrounds” and insert -- the --

Signed and Sealed this

Twenty-second Day of June, 2004

JON W. DUDAS
*Acting Director of the United States Patent and Trademark Office*